US008020901B2

(12) United States Patent
Watanabe

(10) Patent No.: US 8,020,901 B2
(45) Date of Patent: Sep. 20, 2011

(54) HOUSING, OPERATION PANEL INCLUDING THE HOUSING, AND IMAGE FORMING APPARATUS INCLUDING THE OPERATION PANEL

(75) Inventor: Hayato Watanabe, Hiratuka (JP)

(73) Assignee: Ricoh Company, Ltd., Tokyo (JP)

( * ) Notice: Subject to any disclaimer, the term of this patent is extended or adjusted under 35 U.S.C. 154(b) by 858 days.

(21) Appl. No.: 11/475,983

(22) Filed: Jun. 28, 2006

(65) Prior Publication Data

US 2007/0006249 A1 Jan. 4, 2007

(30) Foreign Application Priority Data

Jun. 28, 2005 (JP) ..... 2005-187658

(51) Int. Cl.
*E05C 19/06* (2006.01)
*E05C 19/00* (2006.01)

(52) U.S. Cl. ..... 292/80; 292/81; 292/87; 292/DIG. 61; 292/DIG. 63; 399/411; 312/223.2

(58) Field of Classification Search ..... 292/80, 292/81, 84, 87–89, DIG. 61, DIG. 63; 399/411; 312/223.2
See application file for complete search history.

(56) References Cited

U.S. PATENT DOCUMENTS 4,092,527 A * 5/1978 Luecke ..... 708/140
4,138,151 A * 2/1979 Nakao ..... 292/76
4,851,618 A * 7/1989 Amino et al. ..... 200/5 A
5,137,260 A * 8/1992 Pehr ..... 215/216
5,191,544 A * 3/1993 Benck et al. ..... 361/688
5,295,602 A * 3/1994 Swanson ..... 220/786
5,478,126 A * 12/1995 Laesch ..... 292/87
5,506,657 A * 4/1996 Ito et al. ..... 399/411
5,510,953 A * 4/1996 Merkel ..... 361/679.08
5,577,779 A * 11/1996 Dangel ..... 292/80
5,634,675 A * 6/1997 Mo ..... 292/80
5,657,893 A * 8/1997 Hitchings ..... 220/326
5,931,514 A * 8/1999 Chung ..... 292/89
5,969,245 A * 10/1999 Chiang ..... 73/431
5,971,507 A * 10/1999 Peroni ..... 312/223.2
6,064,564 A * 5/2000 Song et al. ..... 361/679.09
6,307,736 B1 * 10/2001 Song et al. ..... 361/679.09
6,315,142 B1 * 11/2001 Kitamura et al. ..... 220/4.02
6,367,896 B1 * 4/2002 Peng et al. ..... 312/223.2
6,373,692 B1 * 4/2002 Cheng ..... 361/679.59
6,375,283 B1 * 4/2002 Kitamura et al. ..... 312/7.1
6,381,145 B1 * 4/2002 Chen et al. ..... 361/752
6,394,300 B1 * 5/2002 Bosy ..... 220/326
6,478,346 B1 * 11/2002 Veser et al. ..... 292/91
6,721,183 B1 * 4/2004 Chen et al. ..... 361/726

(Continued)

FOREIGN PATENT DOCUMENTS

GB 2244082 A * 11/1991

*Primary Examiner* — Carlos Lugo
(74) *Attorney, Agent, or Firm* — Oblon, Spivak, McClelland, Maier & Neustadt, L.L.P.

(57) ABSTRACT

A housing including a first member, a second member, a first locking mechanism, and a second locking mechanism. The first member is configured to engage with second member. The first locking mechanism locks the first member to the second member, and unlocks in accordance with pressure provided from external of the housing. And the second locking mechanism locks the first member to the second member, and unlocks by rotating either of the first member or the second member at the second locking mechanism.

12 Claims, 9 Drawing Sheets

U.S. PATENT DOCUMENTS 6,805,505 B2 * 10/2004 Horiuchi et al. ..... 400/472
6,816,391 B2 * 11/2004 Davis et al. ..... 361/818
6,876,543 B2 * 4/2005 Mockridge et al. ..... 455/347
7,144,181 B2 * 12/2006 Areh et al. ..... 403/109.3
7,330,216 B2 * 2/2008 Purdy et al. ..... 348/375
2008/0055827 A1 * 3/2008 Homer et al. ..... 361/680

* cited by examiner

HOUSING, OPERATION PANEL INCLUDING THE HOUSING, AND IMAGE FORMING APPARATUS INCLUDING THE OPERATION PANEL

BACKGROUND OF THE INVENTION

1. Field of the Invention

The present invention is directed to a housing, an operation panel including the housing, and an image forming apparatus including the operation panel. More particularly, the present invention is directed to a housing that can accommodate elements in its inner area and that can be locked and unlocked. An operation panel includes the housing and an image forming apparatus includes the operation panel.

2. Discussion of the Background Art

In recent years, manufacturing processes have been separated and are often performed at different sites, for flexibility and cost efficient reasons. For example, a manufacturing operation may produce a unit A that includes a housing or an exterior portion of an overall product at a first factory, and may produce parts that are to be mounted inside of the housing at a second factory. Those parts will then be later assembled into a completed product.

Such a manufacturing operation is becoming increasingly popular from a point of view of a so-called international division of labor or international specification. From an international point of view, it may be more efficient to spread out the manufacturing process of a product such that certain units are produced in a country that has low cost labor and completed products or more sensitive products can be made in another country, for example where the completed products are to be sold.

Such a so-called international division of labor does lead to certain complications. Specifically, different lead times for each production unit or section that forms a part of a completed product have to be addressed.

As is often the case in such situations, units or sections are transferred individually in a condition in which they are tentatively or temporarily assembled, for example to another facility where the completed product will be made. Then, when those tentatively assembled products reach the final assembly site at least certain of the parts must be taken apart and then reassembled to complete the final product by being combined with other sections made for example at other sites.

In general, the tentative assembly and the final assembly at least in some ways use the same steps and operations. As a result, often the time spent for the tentatively assembly can be as much as or close to the time spent for a final assembly.

Another factor to consider is that if the tentative assembly is too thorough of an assembly, parts may be broken by accident when the tentative assembly must be taken apart. On the other hand, if the tentative assembly is too weak and the parts are too easy to take apart, the units or sections may become separated during transit or at an undesired time.

SUMMARY OF THE INVENTION

Accordingly, one object of the present invention is to provide a novel housing that can be used in an assembly operation efficiently and effectively.

A more specific object of the present invention is to provide a novel housing that can be tentatively assembled in a short period of time.

Another object of the present invention is to provide a novel housing that after being tentatively assembled in a short period of time can be taken apart in a short period of time.

Another object of the present invention is to provide a novel operation panel using such a novel housing that can have a more efficient, and thereby less costly, production process.

Another object of the present invention is to provide a novel image forming apparatus including the novel operation panel that can thereby have a more efficient, and thereby less costly, production process.

The present invention achieves the above-noted operation by providing a novel housing, which for example can be used in an operation panel, and the operation panel in turn can be used in an image forming apparatus.

The novel housing includes a first member and a second member configured to be engaged with the first member. A first locking mechanism locks the first member to the second member, and can be unlocked with pressure provided externally of the housing. A second locking mechanism locks the first member to the second member, and is located in a different portion from the first locking member, and can be unlocked by rotating either of the first member or the second member at the second locking member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
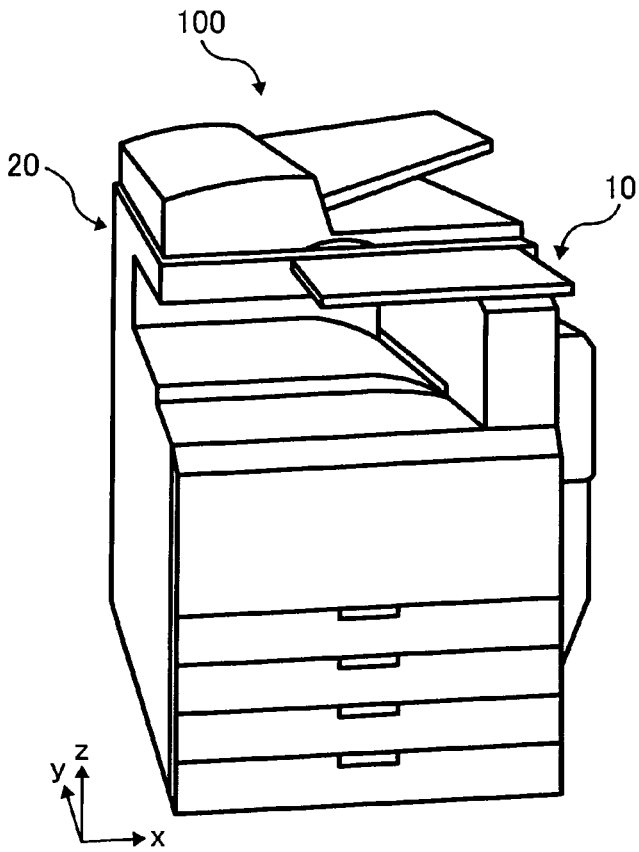
FIG. 1 is an external view showing a copier in an embodiment according to the present invention.

Referring now to the drawings, wherein like reference numerals designate identical or corresponding parts throughout the several views, and more particularly to FIG. 1, a copier 100 is shown. The copier 100 includes an operation panel 10 and a main body 20. The operation panel 10 is fixed in an upper end of the front of the main body 20. The main body 20 operates as a copier to read documents and form images based on the read documents.

The present invention can, for example, be applicable to a housing utilized for forming the operation panel 10 used in the copier 100.

The main body 20 includes a scanner device, a photo-sensitive body, a light scanning device, a developing unit, a transfer device, a fixing unit, a communication device, and a control unit. The scanner device reads image information of a manuscript. The image information is transferred to the light scanning device functioning as a light-exposing mechanism. The light scanning device exposes a surface of the photo sensitive body according to the image information for the purpose of making a latent image. The latent image on the photo sensitive body is developed using toner by the developing unit for changing the latent image into a tangible image. The tangible image on the photo-sensitive body is then transferred to a paper sheet by the transfer device. The tangible image on the paper sheet is then fixed by the fixing unit. The communication device receives input signals from the operation panel 10. The control unit controls each of the units or devices in the main body 20 according to instructions that are included in the input signal from the operation panel 10. In addition, an automatic document feeder (ADF) can be used for the automatic feed of manuscripts. Therefore, the main body 20 can further include the ADF.

Figure 2:
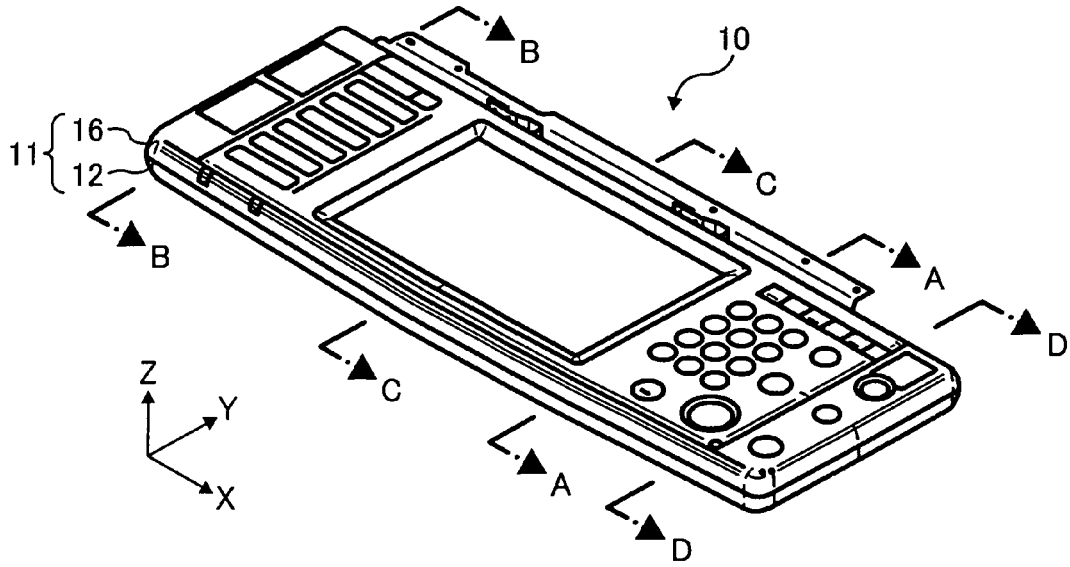
FIG. 2 is a perspective view showing the operation panel of the copier shown in FIG. 1.

As shown in FIG. 2, the operation panel 10 includes a housing 11 having a cover (the upper cover) 16 and a base (a lower cover) 12. The cover 16 and the base 12 are engaged mutually. The housing 11 includes boards 61,62, a display unit 50, and other parts (see FIG. 4) in its internal space.

Figure 3A:
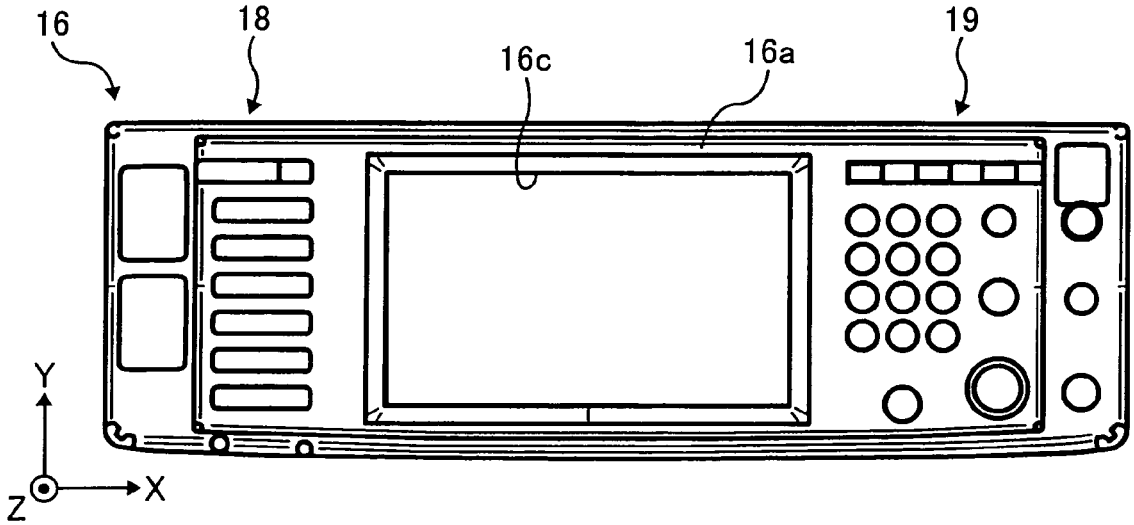
FIG. 3A is a plane view showing a cover of the operation panel shown in FIG. 2.
Figure 3B:
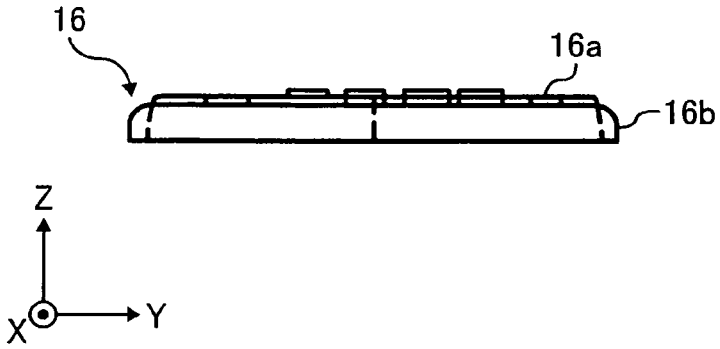
FIG. 3B is a side elevation showing a cover of the operation panel shown in FIG. 2.

As shown in FIG. 3A and FIG. 3B, the cover 16 includes a top board 16*a* and a side wall 16*b*. The top board 16*a* is substantially rectangular and has a longitudinal direction along a shown X axis direction. The side wall 16*b* is formed on the edge of the top board 16*a*. Cover 16 has a U-shape character at the YZ section. As shown in FIG. 3A, in the center of top board 16*a*, an aperture 16*c* is provided having a longitudinal direction along the X axis direction. In the opposite direction in the X axis direction from the aperture 16*c*, there is a first interface part 18 having plural rectangular apertures that are used to insert plural push buttons for selecting functions of the copier 100. A second interface part 19 having plural circular apertures that are used to insert plural push buttons for a numeric keypad or other function is also provided.

The cover 16 can be formed, for example, by injection molding assuming it is made of plastic.

Figure 4:
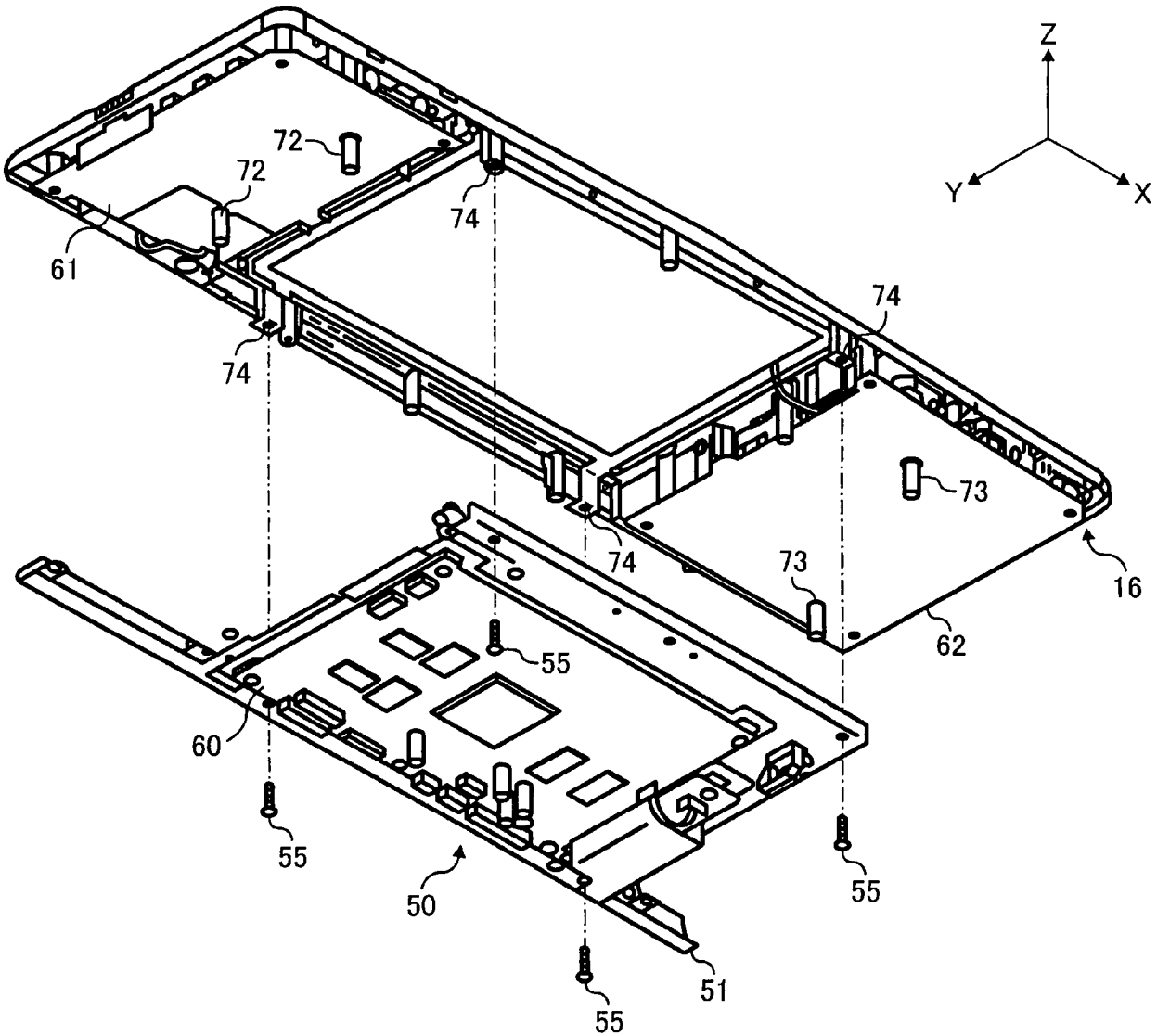
FIG. 4 is a perspective view showing a relation of a cover, boards, and a display unit in the above-mentioned embodiment.

As shown in FIG. 4, the board 61 is accommodated in an internal space of the housing 11 corresponding to the first interface part 18, and the board 62 is accommodated in an internal space of the housing 11 corresponding to the second interface part 19.

On an under surface of the top board 16*a* of the cover 16, two cylindrical projections 72 are provided extending along a Z axis direction. On the other hand, two circular bores on the board 61 are provided corresponding to the two cylindrical projections 72. The board 61 is attached to a lower part of the top board 16*a* of the cover 16 by screws such that projections 72 are inserted in circular bores respectively. On an under surface, which is the counter side across the aperture 16*c* of the top board 16*a*, two cylindrical projections 73 are provided extending along the Z axis direction. On the other hand, two circular bores on the board 62 are provided corresponding to the two cylindrical projections 73. The board 62 is attached to a lower part of the top board 16*a* of the cover 16 by screws such that projections 72 are inserted in the circular bores respectively.

Figure 5:
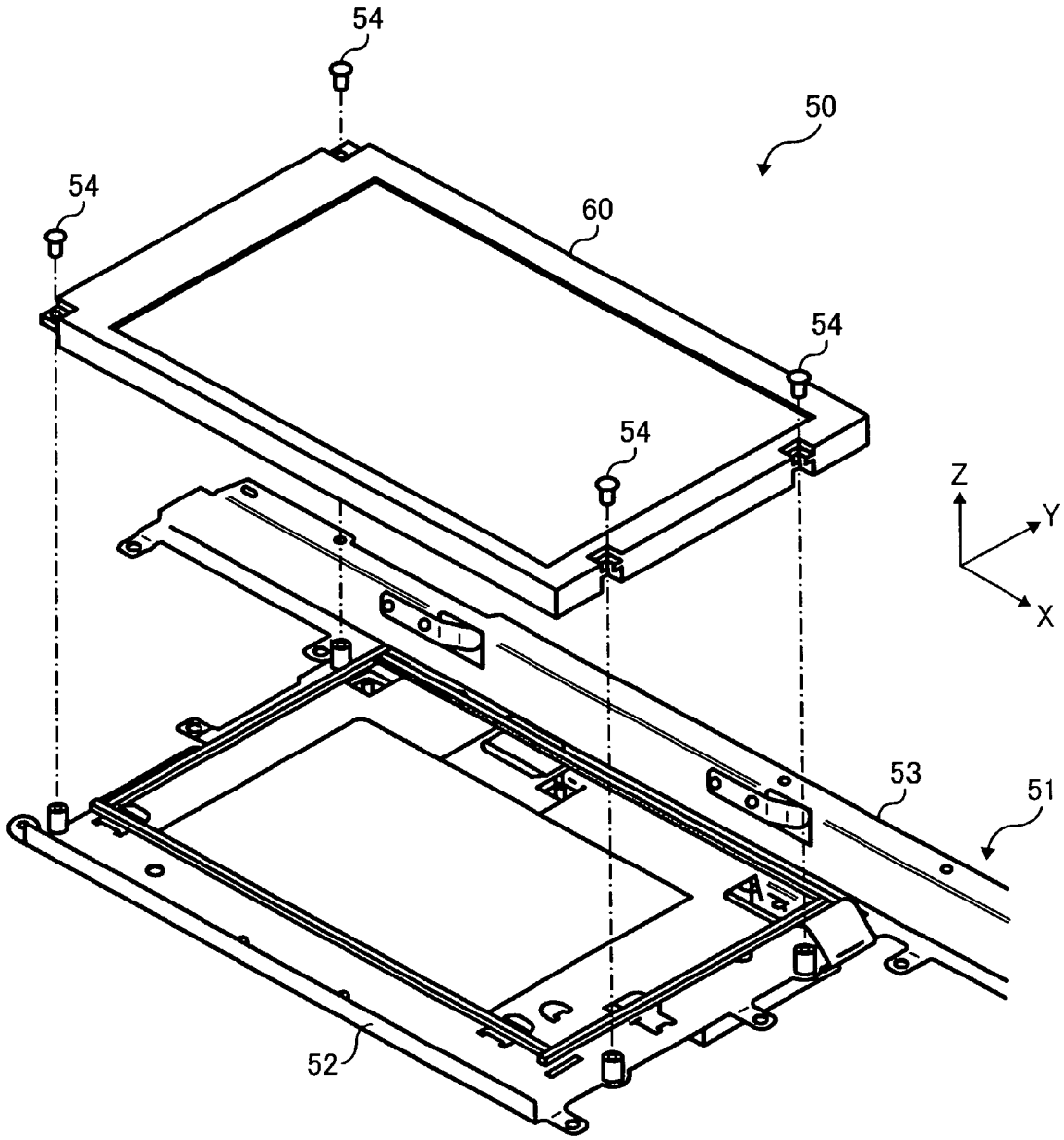
FIG. 5 is a perspective view showing a display unit in the above-mentioned embodiment.

As shown in FIG. 4 and FIG. 5, display unit 50 includes a holder 51 and liquid crystal display 60 held to the holder 51. The holder 51 has a fixing member 53 including a stick member that is S shaped at the YZ section, and an oblong frame 52 that is located at a lower end of the fixing member 53. The holder 51 can be formed, as an example, by sheet metal processing. The liquid crystal display 60 is fixed to the holder 51 by four screws 54.

The display unit 50, as shown in FIG. 4, is attached to the under surface of the top board 16*a* of the cover 16 by using the four screws inserted into four corresponding bores.

Figure 6A:
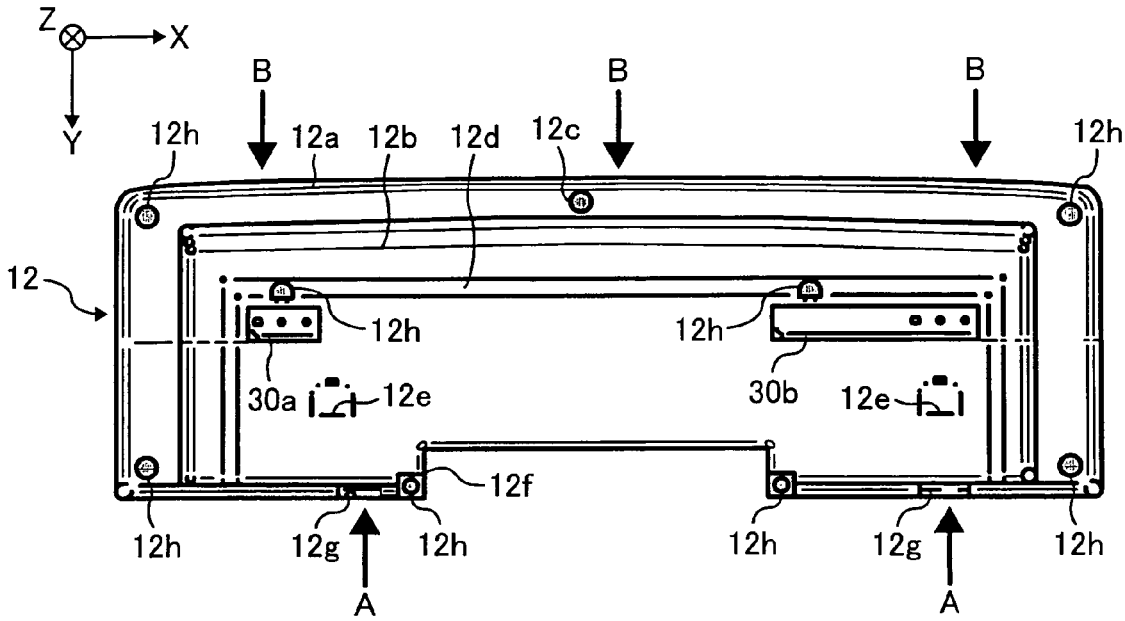
FIG. 6A is a plane view showing a base of the operation panel in FIG. 2.
Figure 6B:
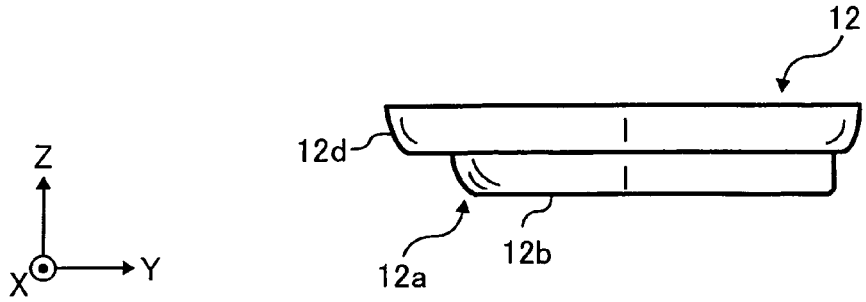
FIG. 6B is a side elevation showing a base of the operation panel in FIG. 2.

As shown in FIG. 6A and FIG. 6B, the base 12 has a bottom board 12*a* and side wall 12*d*. The bottom board 12*a* is substantially rectangular and has a longitudinal direction along an X axis direction. The side wall 12*d* is formed at a circumference of the bottom board 12*a* and has a step.

The base 12 is formed, for example, by injection molding assuming it is made of plastic.

The bottom board 12*a* has an underside 12*b* that is located in the rectangular part, and that is convex downward as shown in FIG. 6B. The underside 12*b* includes the groove 12*c* that is U-shaped in plane view. The groove 12*c* is located in the edge portion of the underside 12*b* except for the edge of the Y direction. The groove 12*c* encloses a pair of depressions 12*e* that are in a line in the X direction of FIG. 6A and that are located adjacent to edges. In an opposite direction in the Z direction from the depressions 12*e*, two metal plates 30*a*, 30*b* are fixed by plural bolts. And the bottom board 12*a* includes depressions 12*h* that are located along the edge. Each of the depressions 12*e* has a circular hole. And the bottom board 12*a* has further two depressions located in the groove 12*c*.

In the area of the central part of the Y-direction end of the base 12, notch 12*f* is formed by being cut out of a part from the underside 12*b* to the side wall 12*d* as a rectangle. A pair of rectangular notches 12*g* are formed at a position shown by arrow A of FIG. 6A of side wall 12*d* which sandwiched notch 12*f*. The notch 12*g* is smaller than notch 12*f*.

Figure 7:
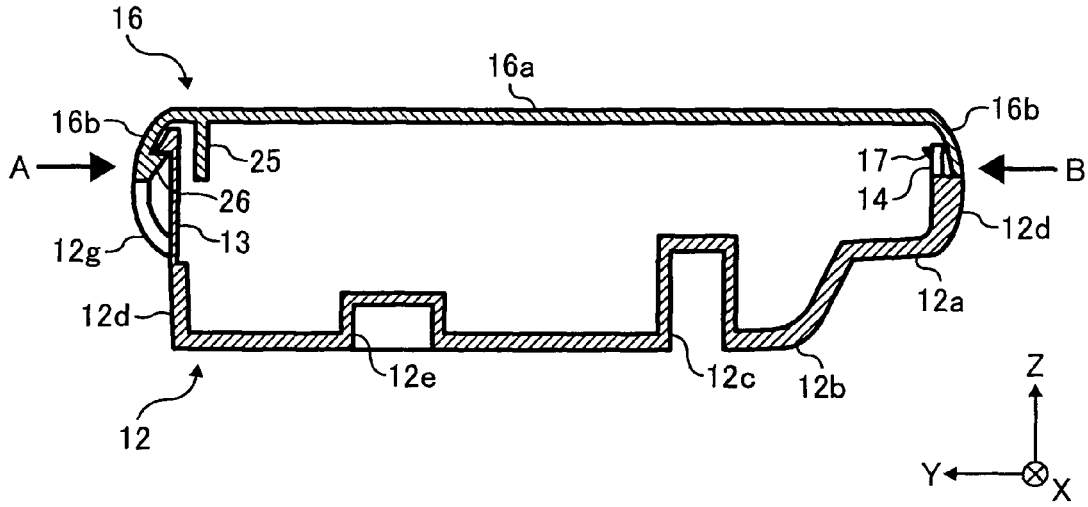
FIG. 7 is a sectional view showing a cross-section view of FIG. 2 along the line A-A with certain omitted elements.

As shown in FIG. 6A and FIG. 7 which is a sectional view along A-A Line of FIG. 2, a first cover side claw 26 is engaged with a base side claw 13 at a position shown at arrow A of FIG. 6A. The first cover side claw 26 is located inside of the side wall 16*b* of the cover 16 and the base side claw 13 is located in an upper side of the side wall 12*d* having notches 12*g* of the base 12.

On the other hand, second cover side claw 17 is engaged with a frame portion 14 at a position shown at arrow B of FIG. 6A. The second cover side claw 17 is located inside of the side wall 16*b* of the cover 16 and frame portion 14 is located in an upper side of the side wall 16*b* of the base 12.

Figure 8:
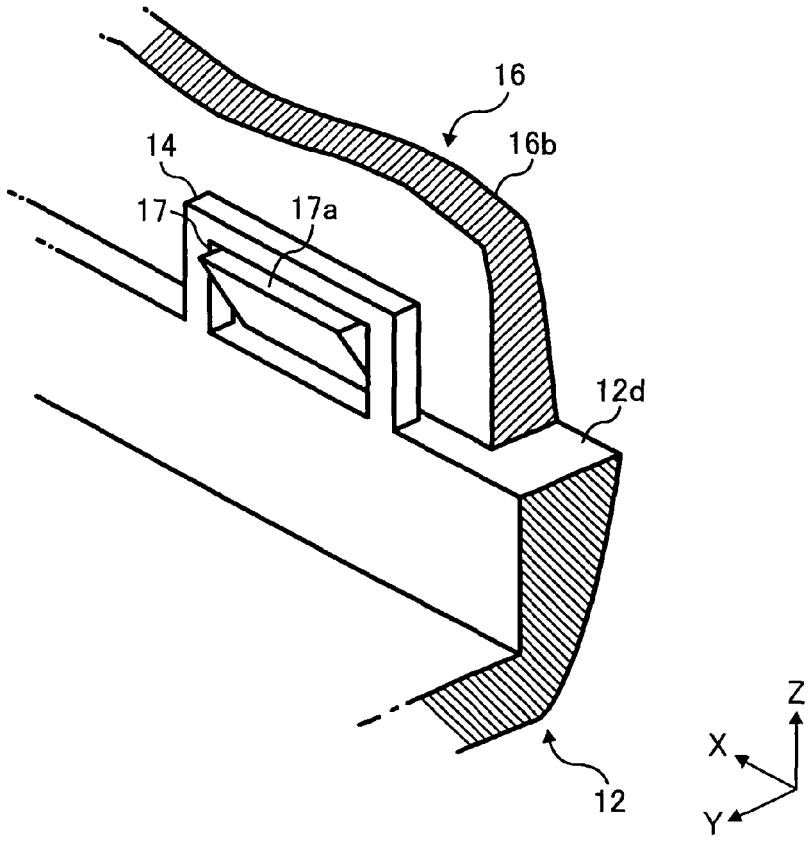
FIG. 8 is a perspective view showing a second locking device in a condition of a cover engaged with a base.

As shown in FIG. 8, which shows engaging of the second cover side claw 17 and the frame portion 14, the second cover side claw 17 has a barb surface 17*a*. The engagement of the second cover side claw 17 and the frame portion 14 is realized by catching the barb surface 17*a* by the frame portion 14. The barb surface 17*a* is substantially parallel with the XY plane.

Figure 9:
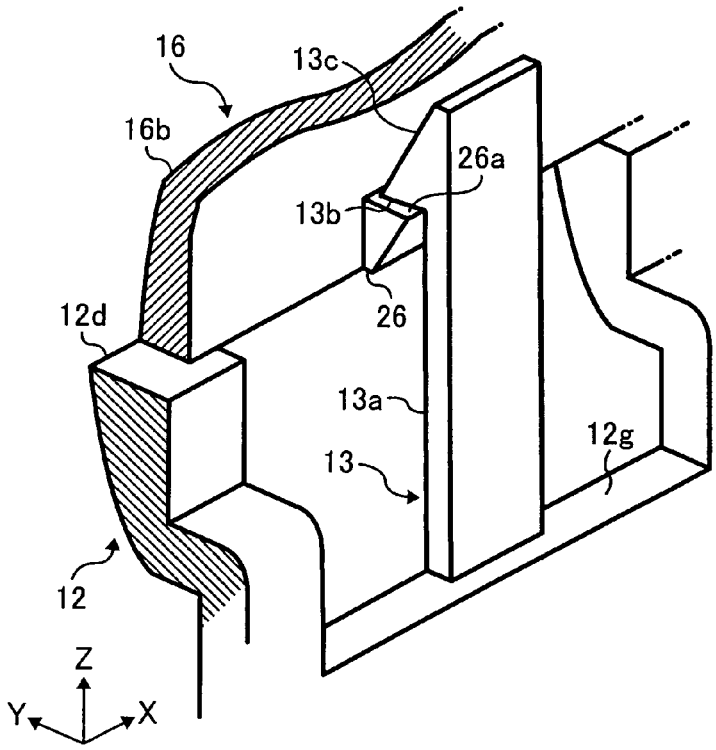
FIG. 9 is a perspective view showing a first locking device in a condition of a cover engaged with a base.

As shown in FIG. 9, the second cover side claw 26 is formed to have a shape of a triangle at its cross section. And the second cover side claw 26 has a barb surface 26*a*. The barb surface 26*a* is located in the Z direction of the second cover side claw 26 and the barb surface 26*a* is substantially parallel with the XY plane. The base side claw 13 is in a form similar to a knitting needle at the YZ section by having a flexible plate portion 13*a* and a barb 13*c*.

Figure 10:
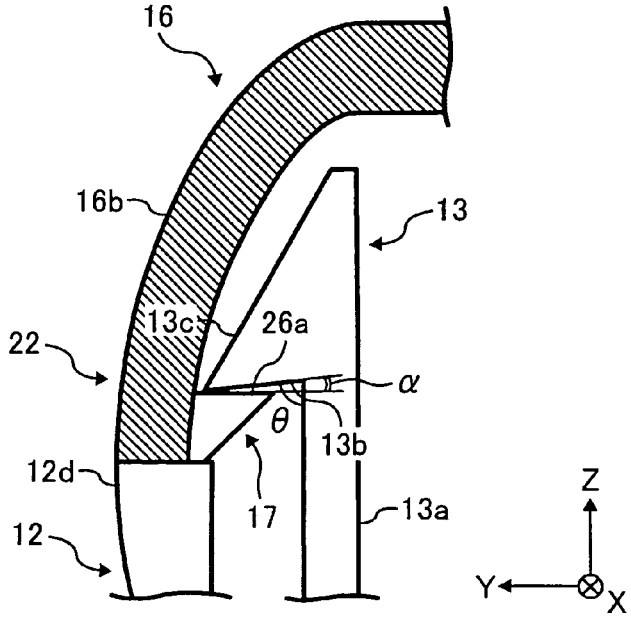
FIG. 10 is sectional view for explaining a flexible plate and a claw formed at a head portion of the flexible plate in the above-mentioned embodiment.

As shown in FIG. 10, the base side claw 13 and the first cover side claw 26 engage by the barb surface 13*b* and barb surface 26*a* coming in contact at an angle α (equal to or less than 10 degrees). In other words the cover side claw 13 includes the barb 13*c* including a surface inclined at an acute angle θ against the flexible plate portion 13*a*. This acute angle is shown in FIG. 10 as angle θ.

The flexible plate portion 13*a* can bend when an external force is applied to it because the flexible plate portion 13*a* is one part of the base 12 that is formed by injection molding assuming it is made of plastic.

In a so-called "tentative assembly" the cover 16 is engaged with the base 12 by the first cover side claw 26, the base side claw 13, the second side claw 17, and the frame portion 14, without requiring a more permanent fastening member such as a screw.

Figure 11A:
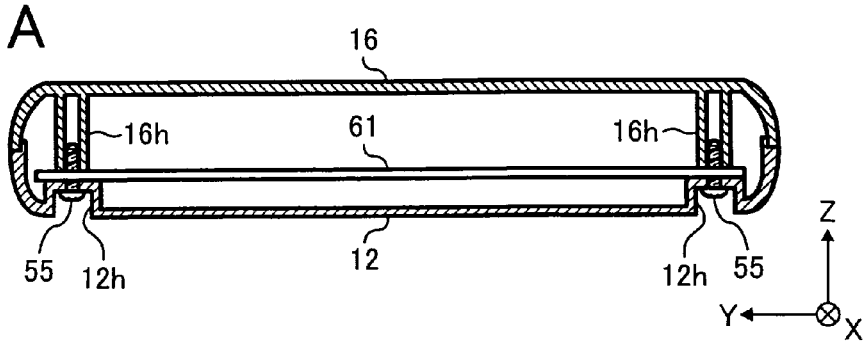
FIG. 11A is a sectional view showing a cross-section view of FIG. 2 along the line B-B with certain omitted elements.
Figure 11B:
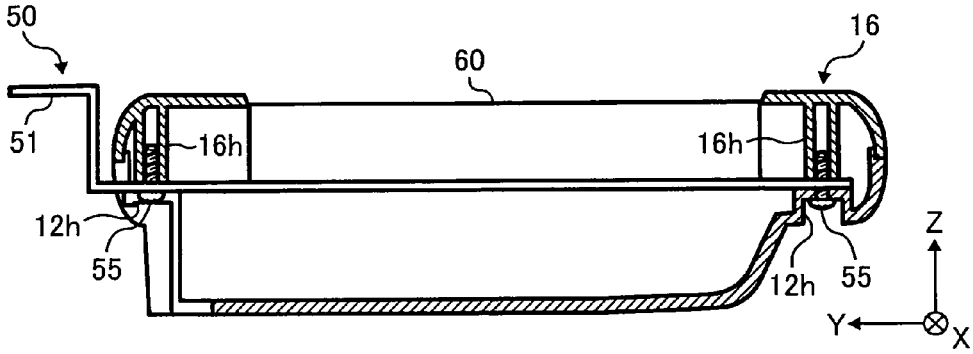
FIG. 11B is a sectional view showing a cross-section view of FIG. 2 along the line C-C with certain omitted elements.
Figure 11C:
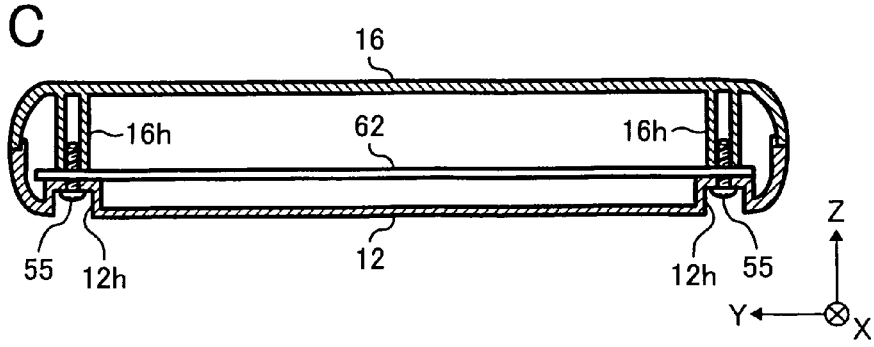
FIG. 11C is a sectional view showing a cross-section view of FIG. 2 along the line D-D with certain omitted elements.

As shown in FIG. 11A which is a sectional view along B-B line of FIG. 2, FIG. 11B, which is a sectional view along C-C line of FIG. 2, and FIG. 11C, which is a sectional view along D-D line of FIG. 2, a "final assembly" is realized as screws 55 are inserted to circular bores that are formed at the depressions 12*h*. Also, the screws 55 arrive to the tube portions formed in the under surface of the top board 16*a* of the cover 16 through the board 61, and the holder 51 or the board 62. In this way, the cover 16 and base 12 are combined. Then the cover 16 and base 12 are mounted on main body 20 by bolts by the intermediary of metal plates 30*a*, 30*b*.

In a so-called "final assembly" the cover 16 and the base 12 in a state of the tentative assembly are fixed by more permanent fastening members such as the screws 55.

According to the housing 11 in the present embodiment, two first cover side claws 26 can be formed in the edge of side wall 12*d* in the Y direction of the cover 16, three second cover side claws can be formed in the edge of side wall 12*d* in the opposite direction of the Y direction of the cover 16, three base side claws 13 can be formed in the edge of side wall 12*d* in the Y direction of the base 12, and three frame portions can be formed in the edge of side wall 12*d* in the opposite direction of the Y direction of the base 12.

Figure 12A:
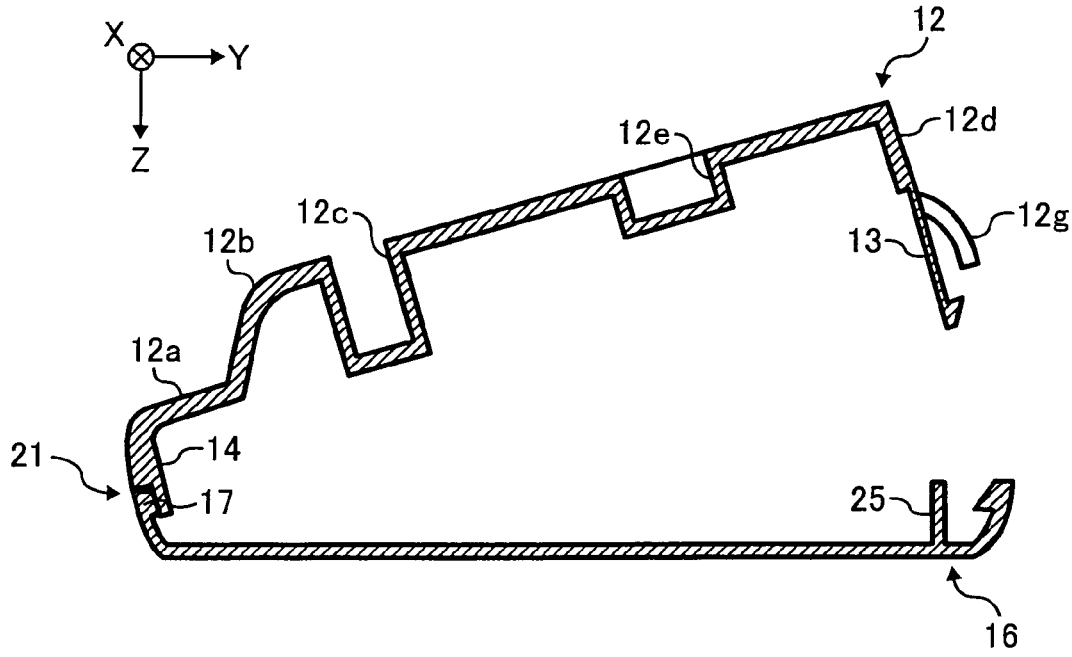
FIG. 12 is a sectional view for explaining deconstructing operations of a cover and base that have been assembled tentatively.
Figure 12B:
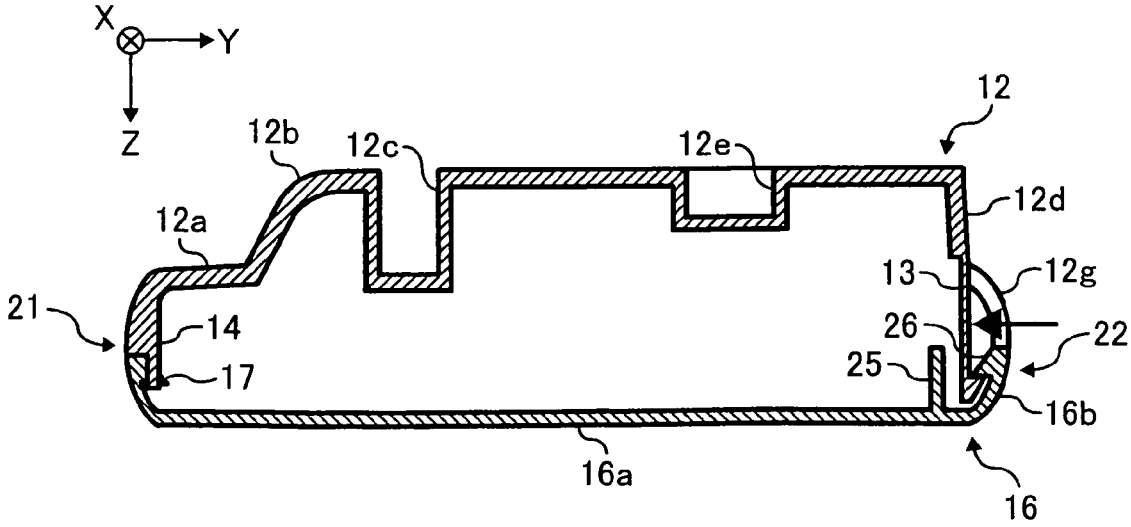

FIG. 12A and FIG. 12B show an assembly and disassembly process in the present invention. Firstly, as shown in FIG. 12A, a frame portion 14 of the base 12 is engaged with a second cover side claw 17 of the cover 16 that has been put down. Secondly, as shown in FIG. 12A and FIG. 12B, base side claw 13 is engaged with first cover side claw 26 by rotating the base 12 clockwise at the portion where the second cover side claw 17 engages with frame portion 14, i.e. the locking mechanism of the second cover side claw 17 and frame portion 14 acts as a pivot for the frame portion 14 or the cover 16. In this way, the base 12 and the cover 16 are easily put in a state of a tentative assembly in a short time without using a tool. As noted above, three frame portions 14, three second side claws 16, two base side claws 13, and two first cover side claws 26 may be utilized, although for simplicity only one of each such element is shown in FIGS. 12A and 12B.

For convenience, the portion in which base side claw 13 is engaged with the first cover side claw 26 is a first engagement portion 22, and the portion in which the frame portion 14 of the base 12 are engaged with the second cover side claw 17 of the cover 16 is a second engagement portion 21.

As shown in FIG. 12B, the engagement between the base claw 13 and the first cover side claw 26 is released in accordance with bending of the base claw 13 by a force that is applied from the outside of the housing 11 along the arrow direction shown in FIG. 12B. For example, the force is generated by the first cover side claw 26 being pushed with a finger. Then, the engagement between the frame portion 14 and the second cover side claw 17 is released by rotating the base 12 counterclockwise at the second engagement portion 21, and in that way the locking mechanism of the frame portion 14 and second cover side claw 17 acts a pivot point for the frame portion 14 or for the cover 16. The frame portion 14 and cover 16 can then be released from one another at the locking mechanism of the frame portion 16 and second cover side claw 17. In this way, the base 12 and the cover 16 are easily taken apart in a short time without using a tool.

In a case in which the first cover side claw 26 is bent by a finger, the first cover side claw 26 is pushed by the finger that is inserted to the notch 12*g*, and the thumb can catch in the depression 12*e* formed in the underside of the base. Thereby, the base side claw 13 can be easily pushed. When a pressing force greater than that required for releasing engagement acts on the base side claw 13, the base side claw 13 is not bent more than necessary because a bending range of the base claw 13 is limited by a stopper 25. Accordingly, the base claw 13 does not break by its plastic deformation.

In addition, the operation panel 10 concerning the present embodiment accommodates the boards 61, 62 and display unit 50 in its inner space. Thereby, when a first factory for attaching the boards 61, 62 to the cover 16 is different from a second factory for attaching the display unit 50 to the cover 16, the second factory can make a complete operation panel 10 by attaching the display unit 50 to the housing 11 after taking apart the housing 11 in the tentative assembly (board 61, 62 is attached).

Therefore, the base 12 and the cover 16 having boards 61, 62 are easily made in a state of a temporary assembly without using a tool. And before attaching the display unit 50 to the housing 11 in the tentative assembly, the housing 11 is easily taken apart.

Accordingly, a cost to produce the operation panel 10 can be reduced.

In addition, in the state of the tentative assembly, a position of the boards 61, 62 is regulated by both projections 72 and cylindrical projections 73 formed in the cover 16. Furthermore, the boards 61, 62 are accommodated in a stable state in the internal space of the housing 11 by being sandwiched by pipe-shaped portions 16*h* and depressions 12*h*. Accordingly, when the display unit is attached to the housing 11, the boards 61, 62 need not be fixed more permanently if the boards 61, 62 need to be detached. Thereby, the tentative assembly can be realized in a shorter time.

And the display unit 50, like boards 61, 62, is accommodated in a stable state in the internal space of the housing 11 by being sandwiched by pipe-shaped portions 16*h* and depressions 12*h*.

Furthermore, as shown in FIG. 10, the base side claw 13 and the first cover side claw 26 engage by the barb surface 13*b* and barb surface 26*a* coming in contact with angle α. Therefore, when a force acts in a direction for detaching the cover 16 from the base 12, a component force is generated in a direction in which the barb 13*c* of the base side claw 13 approaches the side wall 16*c* of the cover 16. Thereby, for example, when each operation panel 10 is taken out from a box in which plural operation panels were packed, the base 12 is not detached from the cover 16 unnecessarily.

In addition, when the operation panel 10 in the state of tentative assembly is attached to the main body 20, it is easily possible to realize the tentative assembly and taking apart of the operation panel 10 in the case of mechanical connection or inspection of a device according to need in a short time. Accordingly, as a result, it is possible to reduce the production cost of the copier 100.

The present invention is not limited to the above-mentioned embodiments. Although the housing 11 is used for the operation panel 10 of the copier 100 in the embodiments discussed above, the housing 11 can be used for a housing in which electronic parts are packed. For instance, the housing 11 can be used for a keyboard of a personal computer.

Furthermore, although a pair of base side claws 13 can be located in base 12 in the embodiments discussed above, one or plural base side claws 13 can be used. However, it is preferable for the base side claws 13 to be in a pair for a taking apart operation when the tentative assembly is dismantled by a manual procedure.

In addition, although the stoppers 25 are located in the cover 16 in the embodiments discussed above, the stoppers 25 can be located in the base 12. Also, an electronic part can be used instead of the stoppers 25.

Furthermore, although the housing 11 is used for the operation panel 16 of the copier 100 in the embodiments discussed above, the housing 11 can be used for a housing of an operation panel of an image forming apparatus, for example a printer, a facsimile, a multifunction peripheral, or the like. Such a multifunction peripheral includes plural functions selected from a copier function, a facsimile function, a printer function, and a scanner function.

As discussed above, the housing of the present invention is suitable to receive electronic parts, and the operation panel of the present invention is suitable to input instructions to an image forming apparatus. Furthermore, the image forming apparatus of the present invention is suitable to form an image according to the instruction from the operation panel.

Obviously, numerous modifications and variations of the present invention are possible in light of the above teachings. It is therefore to be understood that within the scope of the appended claims, the present invention may be practiced otherwise than as specifically described herein.

That application is based on Japanese patent application 2005-187658 filed in the Japanese Patent Office on Jun. 28, 2005, the entire contents of which are hereby incorporated herein by reference.

The invention claimed is:

1. An operation panel assembly comprising:

a housing for accommodating at least one display device;

a first member including an aperture to accommodate an operation panel of the assembly;

a second member configured to be engaged with said first member;

a holder mounted between the first and second members and configured to secure the operation panel to the first and second members within the aperture;

a first assembly mechanism including:

a first locking means for locking said first member to said second member, and for unlocking in accordance with pressure provided from external of said housing, the first locking means including a first claw on the first member engaging with a second claw on the second member;

a notch formed in the first member to receive a user's finger to provide the pressure from external of said housing to unlock the first locking means by pushing against the first claw of the first member; and a second locking means for locking said first member to said second member, which is located in a different portion from said first locking means, and for unlocking by rotating either of said first member or said second member at said second locking means, the second locking means includes a third claw on the second member engaging with a frame portion on the first member that receives the third claw; and a second assembly mechanism including screws extending into both the first and second members to assemble the first and second members to each other more securely than by the first assembly mechanism.

2. The operation panel assembly as defined in claim 1, wherein:

at least one of the claws of the first locking means is formed at a head portion of a flexible plate fixed at a foot portion of either the first member or the second member.

3. The operation panel assembly as defined in claim 2, wherein:

at least one of the claws of the first locking means includes a surface inclined at an acute angle against the flexible plate.

4. An image forming apparatus comprising:

an operation panel;

a main body for forming images according to instructions from the operation panel;

the operation panel for accommodating at least one display device, and including:

a first member including an aperture to accommodate an operation panel of the assembly;

a second member configured to engage with said first member;

a holder mounted between the first and second members and configured to secure the operation panel to the first and second members within the aperture;

a first assembly mechanism including:

a first locking means for locking said first member to said second member, and for unlocking in accordance with pressure provided from external of said housing, the first locking means including a first claw on the first member engaging with a second claw on the second member;

a notch formed in the first member to receive a user's finger to provide the pressure from external of said housing to unlock the first locking means by pushing against the first claw of the first member; and a second locking means for locking said first member to said second member, located in a different portion from said first locking means, and for unlocking by rotating either of said first member or said second member at said second locking means, the second locking means includes a third claw on the second member engaging with a frame portion on the first member that receives the third claw; and a second assembly mechanism including screws extending into both the first and second members to assemble the first and second members to each other more securely than by the first assembly mechanism.

5. The image forming apparatus as defined in claim 4, wherein:

at least one of the claws is formed at a head portion of a flexible plate fixed at the foot portion of either the first member or the second member.

6. The image forming apparatus as defined in claim 5, wherein:

at least one of the claws of the first locking means includes a surface inclined at an acute angle against the flexible plate.

7. An operation panel assembly comprising:

a housing for accommodating at least one display device;

a first member including an aperture to accommodate an operation panel of the assembly;

a second member configured to be engaged with said first member;

a holder mounted between the first and second members and configured to secure the operation panel to the first and second members within the aperture;

a first assembly mechanism including:

a first locking unit configured to lock said first member to said second member, and to unlock in accordance with pressure provided from external of said housing, the first locking unit including a first claw on the first member engaging with a second claw on the second member;

a notch formed in the first member to receive a user's finger to provide the pressure from external of said housing to unlock the first locking unit by pushing against the first claw of the first member; and a second locking unit configured to lock said first member to said second member, which is located in a different portion from said first locking unit, and to unlock by rotating either of said first member or said second member at said second locking unit, the second locking unit includes a third claw on the second member engaging with a frame portion on the first member that receives the third claw; and a second assembly mechanism including screws extending into both the first and second members to assemble the first and second members to each other more securely than by the first assembly mechanism.

8. The operation panel assembly as defined in claim 7, wherein:

at least one of the claws of the first locking unit is formed at a head portion of a flexible plate fixed at a foot portion of either the first member or the second member.

9. The operation panel assembly as defined in claim 8, wherein:

at least one of the claws of the first locking unit includes a surface inclined at an acute angle against the flexible plate.

10. An image forming apparatus comprising:

an operation panel;

a main body for forming images according to instructions from the operation panel;

the operation panel for accommodating at least one display device, and including:

a first member including an aperture to accommodate an operation panel of the assembly;

a second member configured to engage with said first member;

a holder mounted between the first and second members and configured to secure the operation panel to the first and second members within the aperture;

a first assembly mechanism including:

a first locking unit configured to lock said first member to said second member, and to unlock in accordance with pressure provided from external of said housing, the first locking unit including a first claw on the first member engaging with a second claw on the second member;

a notch formed in the first member to receive a user's finger to provide the pressure from external of said housing to unlock the first locking unit by pushing against the first claw of the first member; and a second locking unit configured to lock said first member to said second member, located in a different portion from said first locking unit, and to unlock by rotating either of said first member or said second member at said second locking unit, the second locking unit includes a third claw on the second member engaging with a frame portion on the first member that receives the third claw; and a second assembly mechanism including screws extending into both the first and second members to assemble the first and second members to each other more securely than by the first assembly mechanism.

11. The image forming apparatus as defined in claim 10, wherein:

at least one of the claws of the first locking unit is formed at a head portion of a flexible plate fixed at the foot portion of either the first member or the second member.

12. The image forming apparatus as defined in claim 11, wherein:

at least one of the claws of the first locking unit includes a surface inclined at an acute angle against the flexible plate.

* * * * *